United States Patent [19]

Nagel et al.

[11] 4,318,541

[45] Mar. 9, 1982

[54] DEVICES FOR THE LATERAL ALIGNMENT OF SHEETS

[75] Inventors: Hartmut Nagel; Hans Zimmermann, both of Coswig; Fritz Pieper, Radebeul, all of German Democratic Rep.

[73] Assignee: Veb Kombinat Polygraph "Werner Lamberz" Leipzig, Leipzig, German Democratic Rep.

[21] Appl. No.: 115,287

[22] Filed: Jan. 25, 1980

[30] Foreign Application Priority Data

Feb. 1, 1979 [DD] German Democratic Rep. ... 210750

[51] Int. Cl.[3] ..... B65H 31/36

[52] U.S. Cl. ..... 271/222

[58] Field of Search ..... 271/221, 222, 210

[56] References Cited

U.S. PATENT DOCUMENTS

| | | | |
|---|---|---|---|
| 958,798 | 5/1910 | Fischer | 271/222 |
| 3,385,457 | 5/1968 | Zinn | 271/222 X |
| 3,733,070 | 5/1973 | Obenshain | 271/221 |
| 3,841,622 | 10/1974 | Swanson | 271/221 X |

FOREIGN PATENT DOCUMENTS

| | | | |
|---|---|---|---|
| 801124 | 9/1958 | United Kingdom | 271/221 |

*Primary Examiner*—Richard A. Schacher

*Attorney, Agent, or Firm*—Michael J. Striker

[57] ABSTRACT

A device for positioning sheets in a stack in a sheet-processing machine includes a number of stops positioned at the front edges of the sheets being stacked for aligning the front edges of the sheets, and two joggers located at lateral sides of the stack. Each jogger includes an oscillating plate having a horizontal arm and a vertical arm which extends towards the upper end of the stack. The plate is provided with a drive imparting the oscillating movement to the vertical arm thereof.

9 Claims, 4 Drawing Figures

DEVICES FOR THE LATERAL ALIGNMENT OF SHEETS

BACKGROUND OF THE INVENTION

The invention relates to a device for the lateral alignment of sheets in sheet deliverers of sheet-processing machines, particularly of printing machines.

Devices for the lateral alignment of sheets are intended to act upon distributed sheets and to ensure thereby the forming of a sheet stack of exact positioning and edge alignment and to fix in position the sheet stack thus formed.

Characteristics of known technological solutions German Pat. No. 494,007 discloses a device for the lateral alignment of stacking sheets. This device consists of fixed stops and of tappers linked to stops and spring-loaded, which will vertically oscillate against the stack and align the sheets on the stack.

The disadvantage of this device resides in the fact that the adjustment to the respective sheet width is difficult. When a sheet has a too large distance to the sheet stack the effect upon the sheet is too small, so that no exact stack can be formed. Too small distance to the stack will result in the tapper continuing to act upon the sheet when the sheet is already firmly resting on the stack. Damage to the sheet edges and to the printed image may thus be caused.

The greatest disadvantage of the tappers can be seen in the fact that their action upon the sheet is determined by the respective sheet edge. Sheets of differing cuts, and sheets that are shortened by the natural camber occurring during their falling phase, will not be influenced by the prior art joggers. Sheets of differing cuts will thus make impossible the forming of exact stacks.

SUMMARY OF THE INVENTION

It is an object of the invention to create a device for the lateral alignment of sheets in sheet deliverers, enabling exact stack to be formed in the processing of any type of paper without damaging the sheets or impairing the printed image thereon, the device also allowing facile adjustment to the respective sheet size.

It is another object of the invention to create a device for the lateral alignment of sheets in sheet deliverers by which the sheet is acted upon only during the floating phase and which will also allow acting upon the sheet when cambered and thus shortened in the falling phase, as well as enabling to align sheets having differing cuts.

According to this invention, the above objects are resolved by arranging on a pivot axle located horizontal to the delivered stack, an oscillating plate, movable across the delivered stack. The oscillating plate is of a convex shape and directed toward the delivered stack, and is provided with a horizontal arm and a vertical arm.

A sliding piece, movable over an eccentric sleeve by a drive shaft is subordinate to the horizontal arm of the oscillating plate which is under the load of a compression spring. The fixed stops may be arranged on the rail adjacent to the oscillating plate. It is, however, also possible to arrange the fixed stops below the oscillating plate connected to the stops.

The continuously variable setting of the oscillating angle of the oscillating plate, from "0" to a maximum value is made by means of an adjusting screw.

The device as per invention has the advantage over the known devices, that aligned sheets upon becoming a constituent of the delivered stack, will not be further influenced in any manner by the jogger, so that, apart from avoiding defective edges, the printed image, too, will not be impaired by abrasion or rubbing of the sheets against each other.

The oscillatory arrangement of the oscillating plate, aided by the shape of the oscillating plate allows the oscillating plate to swing into the zone above the delivered stack, so that the oscillating plate will impart aligning impulses only to the falling sheets to be stacked. It thus becomes possible also to align sheets of differing cuts.

The device is simple in its construction and may easily be adjusted to differing sheet sizes and paper types; this, since the the fixed sheet stops fixing the aligned sheet stack, and the oscillating plate effecting alignment, constitute one component of the construction.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
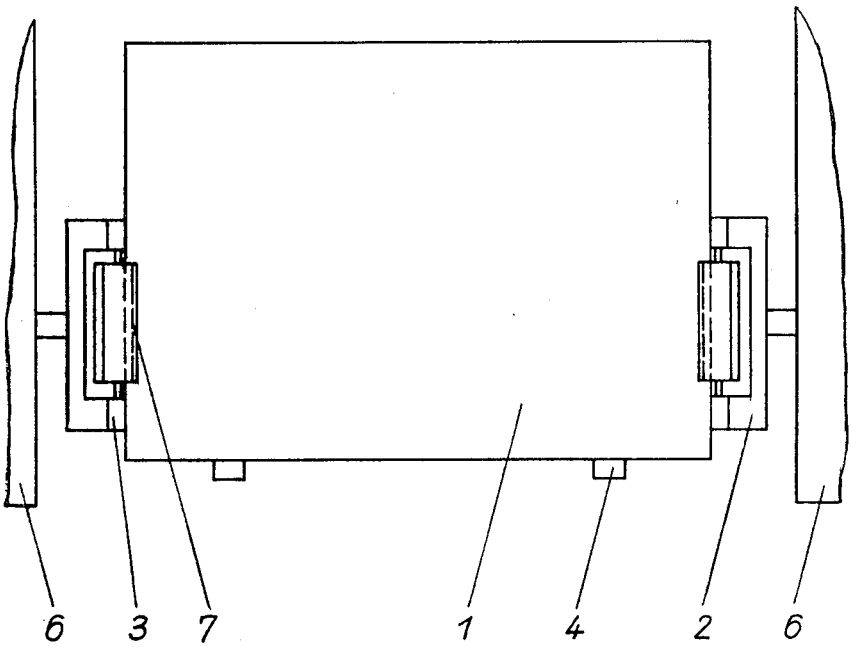
FIG. 1 is a schematic top view of the delivered stack with the device of this invention.

FIG. 1 shows a simplified top view onto a delivered stack 1 with an aligning device having a jogger 2 and fixed lateral stops 3. Sheet stops 4 are arranged at the front edge of the delivered stack 1.

Jogger 2 and stops 3 at each edge of the sheet are attached to a rail 5, arranged between walls 6 of the sheet deliverer at differing distances, corresponding to the sheet width. The stops 3 are located relative to the assigned jogger 2 along a line of sheet alignment.

Figure 2:
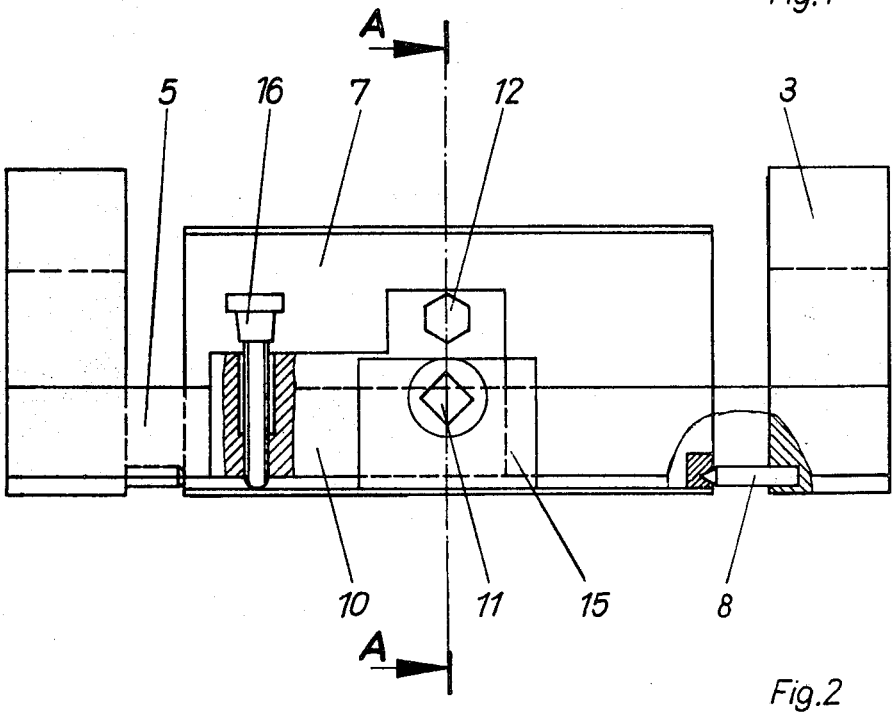
FIG. 2 is a side view partly in section of the aligning device viewed toward the delivered stack.
Figure 3:
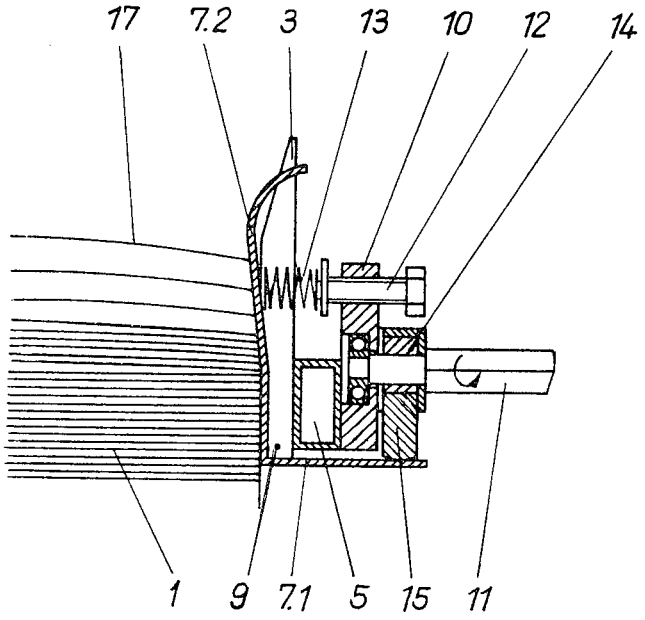
FIG. 3 is a section through the aligning device taken along the line A—A of FIG. 2.

As shown in FIGS. 2 and 3, the jogger 2 consists of an oscillating angular plate 7 having a horizontal arm 7.1 and a vertical arm 7.2. The oscillating plate 7 is pivotally supported at the rail 5 by centering pins 8 holding it along a horizontal edge of the delivered stack 1 for an oscillating movement about the pivoting axle 9. The vertical arm 7.2 of the angular plate 7 may be shaped straight, or deformed convex relative to the upper zone of the upright side of the delivered stack 1. The jogger 2 consists further of a bearing block 10, secured to the rail 5 and serving for the support of a rotary drive shaft 11 and also for the attachment of a threaded bolt 12 with a compression spring 13 pressing against the vertical arm 7.2 of the oscillating plate 7.

An eccentric bushing 14 is fixedly attached to the rotary drive shaft 11, and slidably engages the bore of a sliding piece 15. The sliding piece 15 during its displacement by the bushing 14 acts against the horizontal arm 7.1 of the oscillating plate 7.

An additional adjusting screw 16 is arranged in the bearing block 10. By turning the adjusting screw 16 which is pressing against the horizontal arm 7.1, an actual oscillating angle of the oscillating plate 7 can be continuously adjusted. The maximum oscillating angle is determined by the eccentricity of the eccentric bushing 14.

Figure 4:
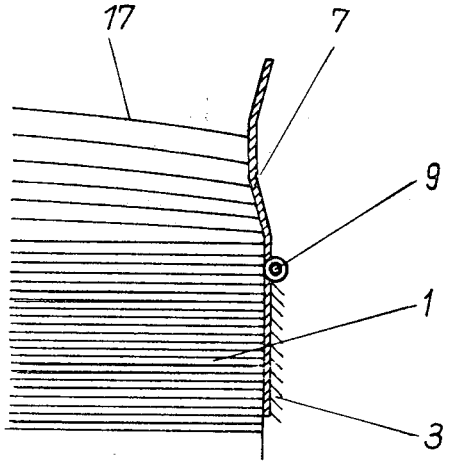
FIG. 4 is a different embodiment of the device shown in FIG. 3.

As shown in FIG. 4, it is also possible to arrange the pivot axle 9 of the oscillating plate 7 above the fixed stop 3 and oscillatable on it. The oscillating plate may, furthermore, be of a shape, viewed toward the delivered stack, having the cross section in the form of a trapezoid (FIG. 4), a triangle or any other suitable shape facilitating swinging into the stacking zone.

Depending on the aforedescribed shape of the oscillating plate 7, the latter may be arranged at a distance to the delivered stack 1 which is larger than that of the fixed stops 3, i.e. the oscillating plate will, in this instance, be set back relative to the stops 3. The device may be adjusted to the respective paper sizes, in longitudinal and lateral directions relative to the delivered stack 1.

Operation of the device as per invention is as follows: By a means of suitable transportation, means for instance by a gripper carriage, a sheet 17 is continually fed over the delivered stack 1, released and stacked. Alignment of the sheets 17 by their front edge is made automatically at the front sheet stops 4. The lateral sheet position is, respectively, effected passively by the lateral stops 3 and actively by the jogger 2.

Operation of the jogger 2 is as follows: The rotatingly driven drive shaft 11 with the fixedly attached eccentric bushing 14 will cause a lifting and lowering motion of the sliding piece 15. This motion is transmitted to the horizontal arm 7.1, causing the oscillating motion of the oscillating plate 7 about the pivot axle 9, so that the vertical arm 7.2 will swing back and forth above the delivered stack 1, thus imparting impulses to the falling sheet 17 which is to be aligned and moving it in the aligned position against the fixed stops 3 at the opposite side. Sliding piece 15 and pressure spring 13 are acting against each other.

The oscillating frequency of the oscillating plate 7, contingent upon the rotational speed of the drive shaft 11, may be, if desired, identical to the free rate of the sheet sequence, whereby the actual oscillating angle is manually adjustable by the adjusting screw 16.

The jogger 2 may be operated at alternating sides which is of advantage for the aligning of sheets 17 with differing cuts.

The construction of the jogger 2 as per invention will allow its use not only in combination with fixed stops 3, but it is also possible to achieve exact stack forming by providing a jogger 2 without stops 3.

As per the above embodiment, the motion of the oscillating plate 7 is generated by a mechanical drive. It is, however, also possible to use a pneumatic or hydraulic drive for the generation of the oscillating motion instead of a mechanical drive.

What is claimed as new and desired to be protected by Letters Patent is set forth in the appended claims:

1. A device for positioning sheets in a stack in sheet transferring arrangements of sheet-processing machines, comprising first means for aligning of front edges of sheets to be stacked, second means for aligning of lateral edges of sheets to be stacked, said second aligning means including a plurality of fixed stops spaced from each other along the lateral edges of sheets being stacked and positioned at the opposite lateral sides of the sheets; and jogging means arranged in contact with the lateral edges of the sheets to be stacked, said jogging means including an oscillating plate having a horizontal arm and a vertical arm extending towards the upper end of the stack to be formed, drive means operatively connected to said horizontal arm for providing the oscillating movement of said plate towards the stack to be formed to impart impulses to falling sheets being stacked, and a compression spring adapted to bias said vertical arm in a direction toward said stack.

2. The device of claim 1, wherein said fixed stops are located below said oscillating plate.

3. The device of claim 1, wherein said oscillating plate is pivotally supported on an axle extending along the lateral sides of the stack to be formed.

4. The device of claim 3, wherein said vertical arm is pivotally supported on said axle.

5. The device of claim 4, wherein said vertical arm is convexly shaped toward the stack to be formed.

6. The device of claim 5, wherein said drive means include a rotary shaft, an eccentric bushing mounted thereon and a sliding member connected to said bushing and arranged in contact with said horizontal arm thereby affecting said oscillating movement.

7. The device of claim 6, further including a pair of rails, said fixed stops being positioned on said rails.

8. The device of claim 7, further including means for adjusting an oscillating angle of said oscillating plate.

9. The device of claim 8, wherein said adjusting means include an adjusting screw arranged to be pressed against said horizontal arm.

* * * * *